US006551154B1

(12) United States Patent
Jaszewski et al.

(10) Patent No.: US 6,551,154 B1
(45) Date of Patent: Apr. 22, 2003

(54) COMBINED TELL-TALE FITTING WITH WATER FLUSHING ATTACHMENT

(75) Inventors: Wayne M. Jaszewski, Jackson, WI (US); John M. Griffiths, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 10/062,253

(22) Filed: Jan. 31, 2002

(51) Int. Cl.[7] ..... B63H 21/10; B60L 1/14
(52) U.S. Cl. ..... 440/88; 440/2
(58) Field of Search ..... 440/2, 88

(56) References Cited

U.S. PATENT DOCUMENTS

| | | | | |
|---|---|---|---|---|
| 3,933,114 A | | 1/1976 | Horn | |
| 4,082,068 A | | 4/1978 | Hale | 123/41 |
| 5,049,101 A | | 9/1991 | Binversie et al. | 440/88 |
| 5,061,214 A | * | 10/1991 | Monaghan | 440/88 |
| 5,080,617 A | | 1/1992 | Broughton et al. | 440/2 |
| 5,634,833 A | * | 6/1997 | Watanabe | 440/88 |
| 5,671,906 A | * | 9/1997 | Rosen | 251/148 |
| 5,823,835 A | | 10/1998 | Takahashi et al. | 440/2 |
| 6,095,166 A | * | 8/2000 | Yoshimura et al. | 134/169 A |
| 6,109,987 A | | 8/2000 | Watanabe et al. | 440/88 |

* cited by examiner

*Primary Examiner*—Jesus D. Sotelo
(74) *Attorney, Agent, or Firm*—William D. Lanyi

(57) ABSTRACT

A tell-tale system is provided for an outboard motor in which the tell-tale fluid conduit is connectable to an external water source, such as a water hose, and is extendable away from the cowl of the outboard motor in order to facilitate its use during a flushing operation. When not being used in the flushing procedure, the connector of the fluid conduit is snapped into position in connection with the cowl to maintain its position when used as a tell-tale port.

11 Claims, 2 Drawing Sheets

COMBINED TELL-TALE FITTING WITH WATER FLUSHING ATTACHMENT

BACKGROUND OF THE INVENTION

1. Field of the Invention

The present invention is generally related to a flushing system for an outboard motor and, more particularly, to a flushing system that comprises a modified tell-tale system.

2. Description of the Prior Art

Tell-tale ports are well known to those skilled in the art and are used to provide a visual indication to the operator that the water cooling system of an outboard motor is operating satisfactorily. The tell-tale port is connected in fluid communication with a pressurized portion of the cooling system for an internal combustion engine and is configured to divert a small, but visual, stream of water from the outboard motor. As long as the diverted stream of water is visible, it is assumed that the cooling system of the internal combustion engine is operating properly.

U.S. Pat. No. 6,109,987, which issued to Watanabe et al on Aug. 29, 2000, describes a coolant flushing system for an outboard motor. A water cooled four cycle outboard motor has an improved flushing system that permits flushing of the cooling system without removal of even the protective cowling and which permits flushing to be accomplished with a minimum of water usage. The flushing connection is coupled with a tell-tale connection to provide a simple, but highly effective construction. In addition, the system effectively cools the engine and a temperature sensor is positioned in an area where it will be protected from overheating.

U.S. Pat. No. 5,823,835, which issued to Takahashi et al on Oct. 20, 1998, describes an outboard motor throttle control system. The system provides an outboard motor for use in powering a watercraft of the type having an operator station positioned along a starboard side of the watercraft. The motor has a water propulsion device powered by an engine having an exhaust system generally positioned along the right side thereof. A cooling system is provided for cooling the engine and the exhaust system. Preferably, the motor includes a cooling water tell-tale acting as a visual identifier to the operator of the craft that the cooling system for the engine is operating. The tell-tale is created by diverting coolant from a portion of the cooling system for cooling the exhaust system to a pilot port in the side of the cowling corresponding to the starboard side of the watercraft.

U.S. Pat. No. 5,080,617, which issued to Broughton et al on Jan. 14, 1992, describes a marine propulsion device with a direct able telltale discharge. The marine propulsion device comprises a propulsion unit adapted to be mounted on the transom of a boat for pivotal movement relative thereto about a generally vertical steering axis, the propulsion unit comprising a lower unit rotatably supporting a propeller shaft adapted to support a propeller, a conduit for providing a discharge of fluid from the propulsion unit, and a nozzle for selectively varying the direction, relative to the lower unit, of the discharge.

U.S. Pat. No. 5,049,101, which issued to Inverse et al on Sep. 17, 1991, describes a marine propulsion with an arrangement for flushing the engine cooling jacket. The device comprises a bracket structure adapted for connection to a boat transom and a propulsion unit connected to the bracket structure for pivotal movement about a generally vertical steering axis and for tilting movement about a generally horizontal tilt axis, which propulsion unit includes an internal combustion engine including an engine block having a cooling jacket, a lower unit supporting the engine block and including a propeller shaft drivingly connected to the engine, a cover removably supported by the propulsion unit in enclosing relation with the engine and including a portion having therein an opening, a conduit extending from the engine block and through the opening and including therein a bore communicating with the cooling jacket and having an outer end with an internal thread, and a plug removably and threadably received in the threaded outer end portion of the conduit.

U.S. Pat. No. 3,933,114, which issued to Horn on Jan. 20, 1976, discloses a self-purging tell-tale nozzle. A resilient rubber self-purging nozzle for the tell-tale water line of a water cooled outboard motor is disclosed. A cone shaped nozzle of soft rubber restricts discharge of tell-tale water stream and expands upon blockage to permit blocking matter to be discharged overboard.

U.S. Pat. No. 4,082,068, which issued to Hale on Apr. 4, 1978, discloses a V-engine cooling system particularly for outboard motors and the like. The engine includes a cooling passageway extending upwardly through the central bore and discharged into a chamber in an exhaust manifold cover between the cylinder banks. The water passes through the cover and to the lateral side edges which have inlets to cooling chambers about the opposite cylinder banks which are continuous and discharged at the uppermost end. The cylinder heads have a cooling chamber with top inlet aligned with the cylinder discharge. The cooling water flows downwardly over to a common discharge header at the lower end for both of the cylinder banks. A pressure relief valve discharges the water from the common headed. A separate thermostatic valve is secured to the uppermost end of each of the cylinder banks at the transfer connection from the cylinder cooling chamber to the head cooling chamber and thus at the uppermost end highest point in the two banks. A lower supply chamber is coupled to a pump having a small bypass opening. The chamber is located at the exhaust pipes and has small ports to spray water into the pipes. Small drains opening from the respective cooling chambers and discharge header drain to the discharge side of the pump for draining of the water from the cooling system through the pump bypass.

The patents described above are hereby expressly incorporated by reference in the description of the present invention.

SUMMARY OF THE INVENTION

A water cooling system for an outboard motor made in accordance with the present invention comprises an internal combustion engine and a water passage disposed in thermal communication with the internal combustion engine. It also comprises a fluid conduit connected in fluid communication with the water passage to cause a visible stream of water to be expelled from the water passage as an indication of an acceptable flow of water through the water passage when the internal combustion engine is operating. The fluid conduit extends through an outer surface of the outboard motor. A connector is attached to a distal end of the fluid conduit and is attachable to a source of water which is external to the outboard motor. The connector is detachable from the outer surface of the cowl in order to allow a preselected length of the fluid conduit to be extending through the outer surface to allow the connector to be moved away from the outer surface.

In certain embodiments of the present invention, the connector is threaded to receive an end of a hose which is connected in fluid communication with the source of water. The hose can be a conventional garden hose. The connector can be removably attached to the outer surface and can comprise a female threaded hose connection. The connector can also comprise a protrusion which is shaped to be received in snap fit relation with a receptacle attached to the outer surface of the outboard motor.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
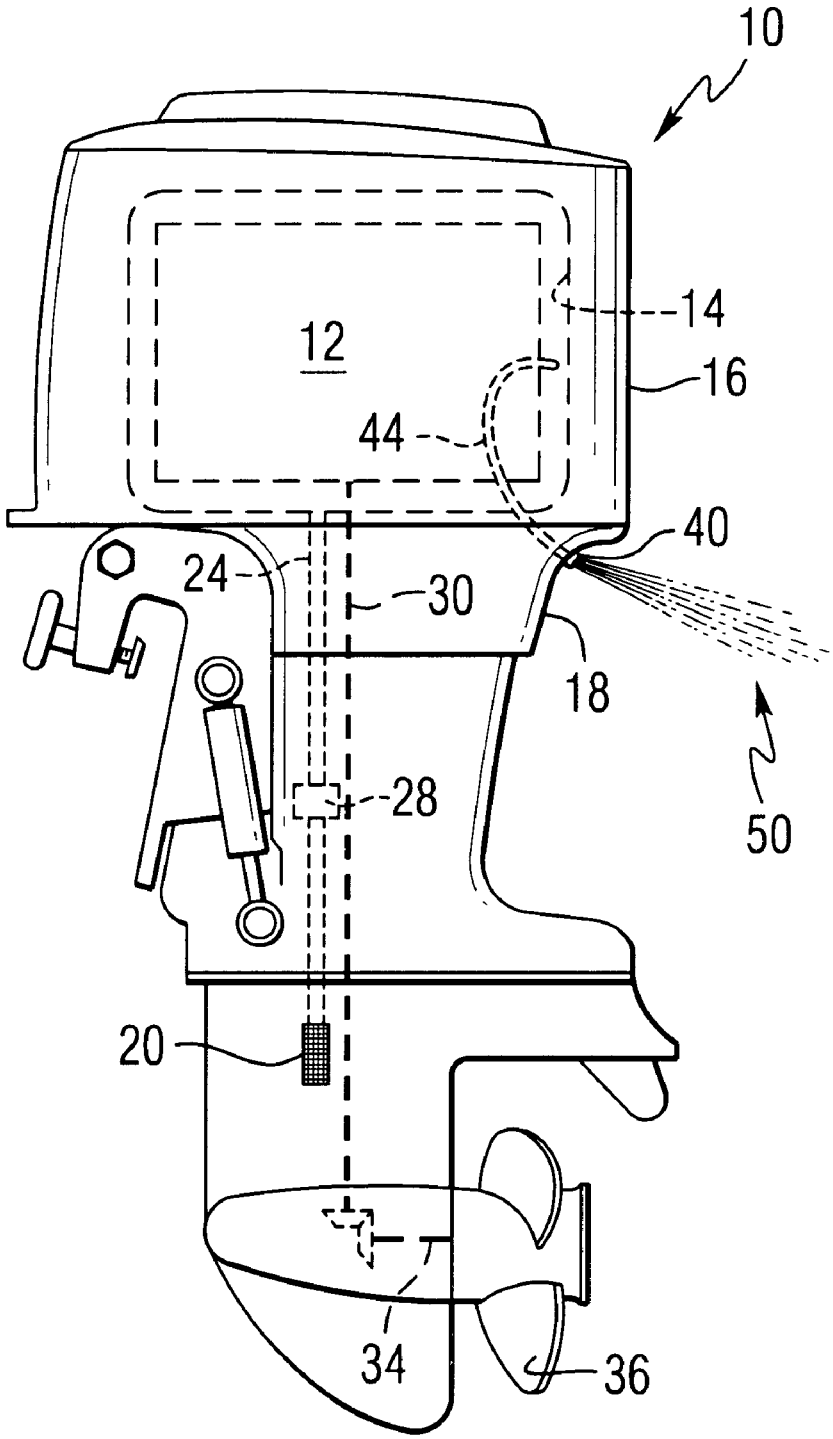
FIG. 1 shows an outboard motor with a tell-tale port and an engine cooling system.

Throughout the description of the preferred embodiment of the present invention, like components will be identified by like reference numerals.

FIG. 1 shows an outboard motor 10 that comprises an internal combustion engine 12 which, in turn, is provided with a water cooling jacket 14. In FIG. 1, the components illustrated by dashed lines are schematically represented. The water jacket 14 typically comprises a plurality of internal passages formed in the engine block in order to conduct cooling water in thermal communication with the heat producing portions of the engine 12. A protective covering of portions of the outboard motor 10 is provided by a removable upper cowl 16 and a lower cowl portion 18.

With continued reference to FIG. 1, many types of outboard motor 10 are provided with an inlet screen 20 which allows water to be drawn from a body of water and conducted upward through an internal water passage 24 to the cooling jacket 14 of the engine 12. A pump 28 causes the water to flow upward from the inlet screen 20 through the inlet passage 24 to the cooling jacket 14. A driveshaft 30 connects the crankshaft of the engine 12 in torque transmitting relation with a propeller shaft 34 to which a propeller 36 is attached. A tell-tale port 40 is connected in fluid communication with the cooling water jacket 14 by a fluid conduit 44. As long as the water within the water jacket 14 is pressurized, water can flow through the fluid conduit 44 and exit from the tell-tale port 40. As a result, a visible stream 50 of water exists when the outboard motor 10 is operating properly. This visible stream 50 of cooling water allows the operator of the outboard motor to see that the water within the cooling jacket 14 is properly pressurized.

With continued reference to FIG. 1, it can be seen that the fluid conduit 44 is longer than necessary to traverse the distance between its connection to the water jacket 14 and its connection to the tell-tale port 40. As will be described in greater detail below, this extra length of fluid conduit 44 allows the operator to extend a connector, which will be described below, away from the lower cowl 18 in order to facilitate connection to an external source of water, such as a garden hose, in order to allow the cooling system of the outboard motor 10 to be flushed.

Figure 2:
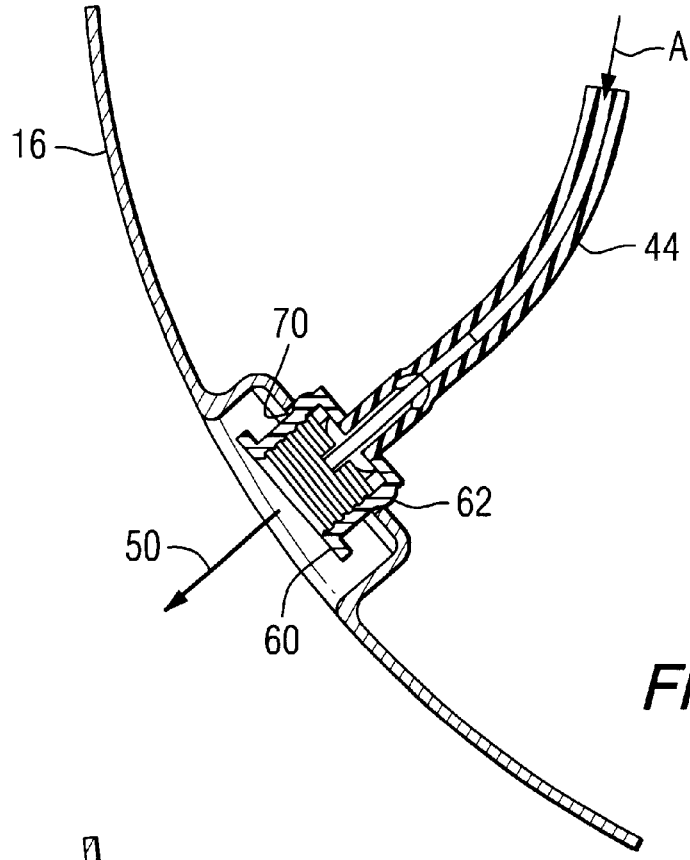
FIG. 2 shows the tell-tale port of the present invention.
Figure 3:
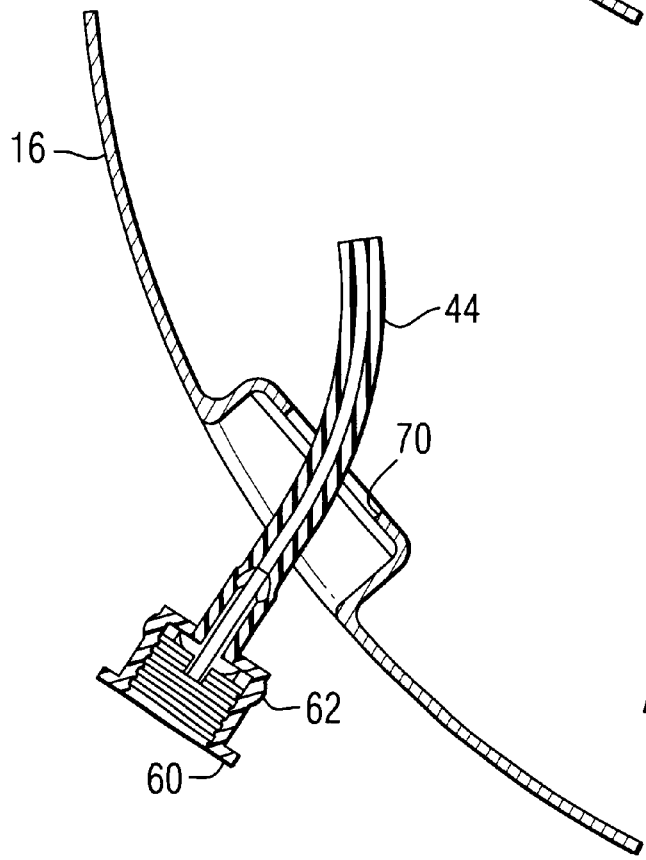
FIG. 3 shows the tell-tale port of the present invention when it is extended away from the cowl.

FIGS. 2 and 3 show the present invention in two different conditions. In FIG. 2, the connector 60 is held in place relative to the cowl 16, or protective covering, by the relationship between a protrusion 62, formed in the connector 60, and an opening 70, formed in a receptacle portion of the cowl 16. When the outboard motor is operating normally and the cooling system is functioning properly, a small portion of the cooling water is diverted through the fluid conduit 44, as represented schematically by arrow A, and flows through the connector 60 to form a tell-tale stream 50 of water that is visible to the operator.

When the operator wants to flush the cooling system of the outboard motor, the connector 60 can be disconnected from the cowl 16 by pulling on the connector in a direction away from the cowl. This allows the protrusion 62 to be pulled away from its opening 70. The operator can then move the connector 60 away from the cowl 16 by a predetermined distance that is a function of the amount of extra length of fluid conduit 44 provided between the connector 60 and its opposite end where the fluid conduit 44 is connected to the water jacket 14 as described above in conjunction with FIG. 1. The connector 60, in the embodiment shown in FIGS. 2 and 3, is shaped to receive the male end of a conventional water hose. In this embodiment, the connector 60 is threaded to provide a female connection to receive the water hose and can be rotatable relative to the fluid conduit 44. Water can then be caused to flow from the water hose through the connector 60, through the fluid conduit 44, and into the water cooling jacket 14. This allows the operator of the outboard motor to flush the cooling system.

With reference to FIGS. 1–3, it can be seen that the present invention comprises an internal combustion engine 12 and a water passage, which includes the water jacket 14, that is disposed in thermal communication with the internal combustion engine 12. A fluid conduit 44 is connected in fluid communication with the water passage 14 to cause a visible stream 50 of water to be expelled from the water passage 14 when the internal combustion engine 12 is operating properly. The fluid conduit 44 extends through an outer surface of the outboard motor, which is illustrated as the lower cowl 18 in FIG. 1. A connector 60 is attached to a distal end of the fluid conduit 44 and is attachable to a water source, such as a garden hose, which is external to the outboard motor 10. The connector 60 is rotatable relative to the fluid conduit 44 and detachable from the outer surface to allow a preselected length of the fluid conduit 44 to be extended through the outer surface of the outboard motor in order to allow the connector 60 to be moved away from the outer surface. The connector is threaded, as illustrated in FIGS. 2 and 3, in a preferred embodiment of the present invention for the purpose of receiving the end of a garden hose which is connected in fluid communication with an external source of water. The connecter is removably attached to the outer surface, as represented in FIGS. 2 and 3, and can comprise a female threaded hose connection. The connector 60 can also comprise a protrusion 62 which is shaped to be received in snap fit relation with a receptacle opening 70 which is attached to the outer surface.

Although the present invention has been described in considerable detail and illustrated to show one embodiment, it should be understood that alternative embodiments are also within its scope.

We claim:

1. A water cooling system for an outboard motor, comprising:

an internal combustion engine;

a water passage disposed in thermal communication with said internal combustion engine;

a fluid conduit connected in fluid communication with said water passage to cause a visible stream of water to be expelled from said water passage as an indication of an acceptable flow of water through said water passage when said internal combustion engine is operating, said fluid conduit extending through outer surface of said outboard motor; and a connector attached to a distal end of said fluid conduit, said connector being attachable to source of water which is external to said outboard motor, said connector being detachable from said outer surface to allow a preselected length of said fluid conduit to be extended through said outer surface to allow said connector to be moved away from said outer surface.

2. The water cooling system of claim 1, wherein:

said connector is threaded to receive an end of a hose which is connected in fluid communication with said source of water.

3. The water cooling system of claim 1, wherein:

said connector is removably attached to said outer surface.

4. The water cooling system of claim 1, wherein:

said connector is a female threaded hose connection.

5. The water cooling system of claim 1, wherein:

said connector comprises a protrusion shaped to be received in snap fit relation with a receptacle attached to said outer surface.

6. A water cooling system for an outboard motor, comprising:

an internal combustion engine;

a water passage disposed in thermal communication with said internal combustion engine;

a fluid conduit connected in fluid communication with said water passage to cause a visible stream of water to be expelled from said water passage as an indication of an acceptable flow of water through said water passage when said internal combustion engine is operating, said fluid conduit extending through a cowl of said outboard motor; and a connector attached to a distal end of said fluid conduit, said connector being attachable to source of water which is external to said outboard motor, said connector being removably attached to said cowl to allow a preselected length of said fluid conduit to be extended through said cowl to allow said connector to be moved away from said cowl, said connector being threaded to receive an end of a hose which is connected in fluid communication with said source of water.

7. The water cooling system of claim 6, wherein:

said connector is a female threaded hose connection.

8. The water cooling system of claim 7, wherein:

said connector comprises a protrusion shaped to be received in snap fit relation with a receptacle attached to said cowl.

9. A water cooling system for an outboard motor, comprising:

an internal combustion engine;

a water passage disposed in thermal communication with said internal combustion engine;

a fluid conduit connected in fluid communication with said water passage to cause a visible stream of water to be expelled from said water passage as an indication of an acceptable flow of water through said water passage when said internal combustion engine is operating, said fluid conduit extending through a cowl of said outboard motor; and a connector attached to a distal end of said fluid conduit, said connector being attachable to source of water which is external to said outboard motor, said connector being removably attached to said cowl to allow a preselected length of said fluid conduit to be extended through said cowl to allow said connector to be moved away from said cowl, said connector comprising a protrusion shaped to be received in snap fit relation with a receptacle attached to said cowl.

10. The water cooling system of claim 9, wherein:

said connector is threaded to receive an end of a hose which is connected in fluid communication with said source of water.

11. The water cooling system of claim 10, wherein:

said connector is a female threaded hose connection.

* * * * *